United States Patent [19]

Scott

[11] Patent Number: 5,007,029

[45] Date of Patent: Apr. 9, 1991

[54] UNDERSEA RELOCATION APPARATUS & METHOD

[76] Inventor: Sherman A. Scott, 120 Greenbriar Cir., Lafayette, La. 70503

[21] Appl. No.: 220,921

[22] Filed: Oct. 26, 1987

Related U.S. Application Data

[63] Continuation of Ser. No. 836,640, Mar. 5, 1986, abandoned.

[51] Int. Cl.[5] ..... H04B 1/59

[52] U.S. Cl. ..... 367/4; 114/293

[58] Field of Search ..... 367/2–4, 367/133; 441/1, 2, 6; 114/230, 293

[56] References Cited

U.S. PATENT DOCUMENTS

| | | | |
|---|---|---|---|
| 1,183,663 | 5/1916 | Murray | 441/6 |
| 2,490,876 | 12/1949 | Lewis et al. | 441/6 |
| 3,653,085 | 4/1972 | Rovner | 441/6 |
| 4,067,282 | 1/1978 | Guinn et al. | 367/133 |
| 4,501,563 | 2/1985 | Johnson et al. | 441/6 |
| 4,535,430 | 8/1985 | Cochrane, Jr. et al. | 367/133 |
| 4,544,364 | 10/1985 | Bankston | 441/6 |
| 4,601,126 | 7/1986 | Klocksiem | 441/6 |

*Primary Examiner*—Thomas H. Tarcza
*Assistant Examiner*—Daniel T. Pihulic
*Attorney, Agent, or Firm*—Matthews & Assoc.

[57] ABSTRACT

The present invention relates to a undersea relocation system and more particularly relates to an apparatus for relocating underwater objects by means of a retrievable line carrying buoyant spool which is released to the surface responsive to a remote signal, the spool line remaining connected to the object to be relocated.

6 Claims, 2 Drawing Sheets

UNDERSEA RELOCATION APPARATUS & METHOD

This application is a continuation, of application Ser. No. 836,640, filed Feb. 5, 1986, now abandoned.

SUMMARY OF THE INVENTION

The present invention relates to a undersea relocation system and more particularly relates to an apparatus for relocating underwater objects by means of a retrievable line carrying buoyant spool which is released to the surface responsive to a remote signal, the spool line remaining connected to the object to be relocated.

BACKGROUND OF THE INVENTION

Frequently it is desired to relocate underwater objects which are at great depths and in dark or murky waters. Due to the difficulty of relocating these objects, several methods and systems have been devised that include buoys secured to the object by canister lines which may be released by remote signal, most commonly a sonic signal. One such method is disclosed in U.S. Pat. No. 4,535,430 issued to Cochrane, et al. Other subsea relocation systems are disclosed in U.S. Pat. Nos. 2,739,296; 2,594,702; 3,722,014; 4,262,379; and 3,066,325. Further, remote activator release mechanisms are disclosed in U.S. Pat. Nos. 3,199,070 and 3,729,755.

All of the disclosed systems require a line containing canister which is placed near the subsea object. A separate buoy is attached to the canister line, the buoy being released by a remote signal and rising to the surface carrying the canister line which pays out of the canister. This type of an arrangement often causes problems in that the line becomes tangled, requiring a special non-hackling rope as disclosed in U.S. Pat. No. 4,535,430. Further, such devices as disclosed in the above patents include a multitude of parts, all of which have to be located near the subsea object.

The present invention does away with the necessity of the line containing canister and greatly simplifies the system used to relocate subsea objects. The present invention does not require a separate buoy and canister, and the advantages of the instant invention are readily apparent. The simplicity of the invention of using a buoyant line containing spool with the line and the spool being connected to a pennant line by a remotely operated release mechanism does away with the necessity of having a line containing canister and non-hackling line. Further, the specific configuration of the spool such that is rises to the surface with its horizontal axis being parallel to the surface when constrained by the line on the spool, allows the line to pay out evenly and prevents entangling. Lastly, the simplicity of the present invention provides a convenient and inexpensive method of relocating subsea objects.

OBJECTS OF THE INVENTION

In view of the foregoing, it is an object of the present invention to provide a simple inexpensive subsea relocation system.

It is a further object of the invention to provide an apparatus that will pay out the line without entanglements.

BRIEF DESCRIPTION OF THE DRAWING

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
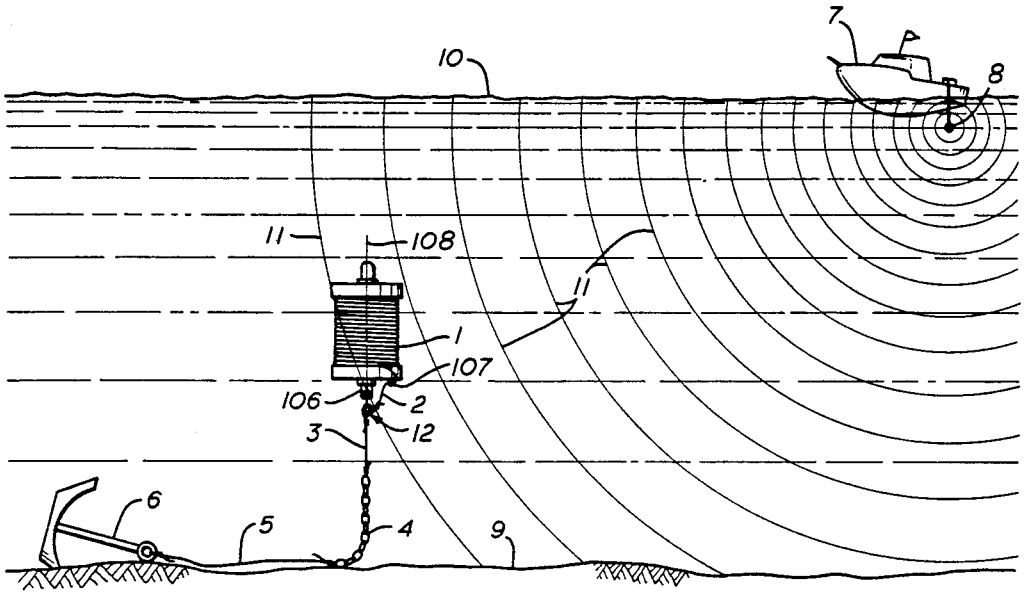
FIG. 1 is a side elevational view of the present invention attached to the object to be relocated and below the surface including a indication of a signal emanating from a boat.
Figure 2:
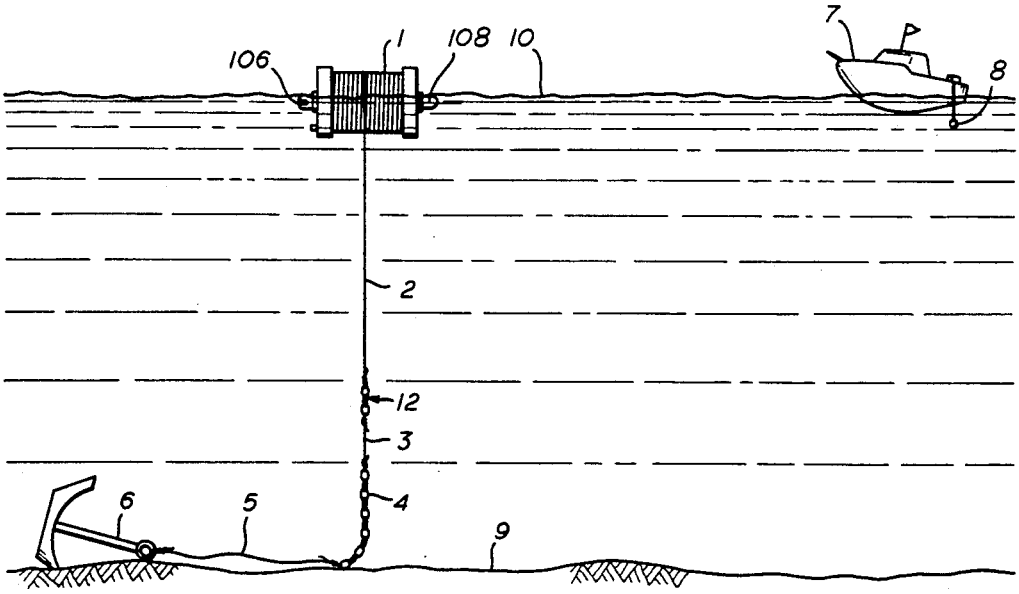
FIG. 2 is a side elevational view of the present invention illustrating the tipping motion of the buoyant spool and the spool floating on the surface.

FIGS. 1 and 2 show an underwater object 6 such as an anchor which may be relocated later as desired. The underwater object (anchor) 6, lies upon the sea floor 9 which is a distance below the water surface 10. A boat 7 on the surface 10 is equipped with a transponder 8 for a emitting an acoustic signal 11.

Figure 3:
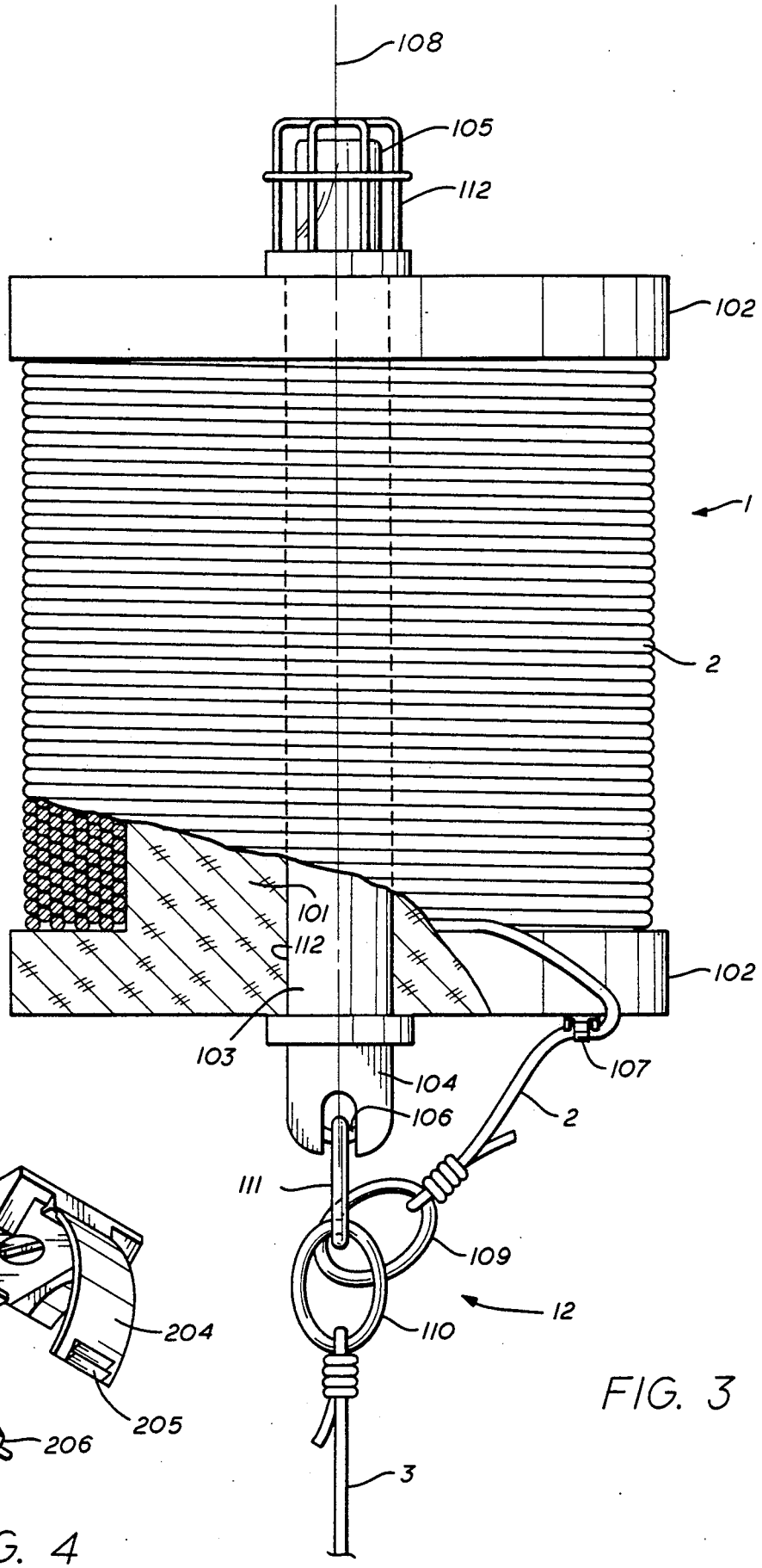
FIG. 3 is a side elevational sectional view showing the detail of the release mechanism within the buoyant spool and the configuration of the buoyant spool.

An anchor pennant line 5 is connected by one end to the object to be relocated 6. The opposite end of the pennant line is connected to one end of a lug chain 4 which in turn is connected at the other end to one end of a mooring line 3. The opposite end of the mooring line 3 is connected by rings generally shown at 12, more detail of which is shown in FIG. 3, to a releasable catch means indicated at 106. A buoyant spool is indicated at 1, the spool having a spool line 2 connected by one end to the spool and wound about the spool, the other end being connected to the end of the mooring line 3 and a releasable attachment means 106 which is responsive to a trigger means shown as 103 in FIG. 3.

The length of the anchor pennant line 5 should be sufficient to reach to the surface 10 from the sea floor 9. The lug chain 4 serves the purpose of keeping the anchor pennant line 5 secured to the sea floor. The length of the spool line 2 is conveniently set at 600 feet as this has been found to be a sufficient depth to clear any surface traffic. Therefore, the length of the mooring line 3 is adjusted such that the buoyant spool 1 is anchored no more than 500–600 feet below the surface.

Generally, the strength of the mooring line is not sufficient to pull the object 6 to the surface but only sufficient to pull up the anchor pennant line 5 which does have sufficient strength to relocate the object 6. Since the strength of the mooring line 3 is somewhat less than that of the anchor pennant line 5, its weight per foot is somewhat less. Additionally, the weight per foot of the spool line 2 is considerably less than that of either the mooring line 3 or the anchor pennant line 5. This reduces the buoyancy necessary in the spool 1 to lift the spool and the spool line 2 to the surface. In the arrangement shown in FIGS. 1 and 2, the weight of the chain 4 is sufficient to overcome the buoyancy of the spool 1.

As more specifically outlined below, the configuration of the spool 1 is designed such that the spool, when released, will tip while constrained by spool line 2 until the longitudinal axis of the spool 108 is horizontal as shown in FIG. 2 and rise to the surface in the horizontal position thus allowing the spool line 2 to pay out evenly without tangling. FIG. 3 shows more particularly the construction of the spool 1 and the arrangement of the spool line 2, the mooring line 3, and the releasable attachment means 106. The spool 1 has a central buoyant section 101 in the form of essentially a solid cylinder with a receptacle 112 disposed in the center along the center axis 108 for receiving and holding trigger means 103 for opening the catch 106.

Intergrally formed with and separated by the first buoyant section are two spool flanges 102, which act as spool line retainers and guides. Additionally, the flanges provide extra buoyancy at either end of the axis 108 due to the increase in volumes. This additional buoyancy at the end of the axis 108 causes the spool to tip upon release and rise in the fashion indicated above with the longitudinal axis 108 parallel to the surface as shown in FIG. 2.

The entire buoyant spool 1 is made of a material having a density of between 30–40 pounds per cubic feet—preferably 32 pounds per cubic feet. This density has been found to provide sufficient mass to allow the spool to unwind evenly and also provide sufficient buoyancy to lift the spool 1 and spool line 2 to the surface.

The trigger means 103 as shown is an acoustic transponder of a type such as is manufactured under the name COMPATT manufactured by Sonardyne of Hampshire, U.K. and available in the United States. Such a COMPATT unit is purchased complete with the release end cap assembly 104 having a releasable catch 106.

The catch 106 of the release end cap assembly 104 will release upon a signal from a surface unit known as a programmable acoustics navigator (PAN), also manufactured by Sonardyne. The COMPATT unit as shown also includes a light 105 encased in a protective cage which flashes in response to the same signal that opens the catch 106, thus making the buoy easy to locate on the surface.

The invention is not limited to an acoustic type trigger system. Any type of releasable catch would be suitable. A diver released mechanical catch or other trigger means would perform the same function.

The arrangement of the spool line 2 which is wound around the spool 1 is further shown in FIG. 3. The spool line 2 is attached to one of the spool flanges 102 by a mechanical release mechanism 107 which is more fully described hereinbelow. This attachment prevents the spool line from unwinding due to wave action underneath the ocean. The release mechanism is selected such that the buoyancy of the spool 1 will cause the release mechanism to open and thereby release the spool line. The ends of the spool line 2 and mooring line 3 each have a ring 109 and 110 respectively which are connected by a third ring 111. The third ring 111 additionally acts as a connector to the catch 106 of the release end cap 104.

Figure 4:
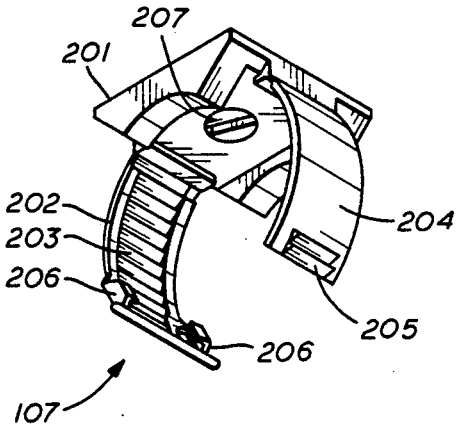
FIG. 4 is side perspective view illustrating one type of mechanical release mechanism which attaches the spool line to the spool.

FIG. 4 is a detailed prospective view of the mechanical release mechanism 107 which mechanically opens in response to the buoyant force of the spool 1 when the release catch 106 is opened. As shown, the mechanical release mechanism has a generally rectangular base 201 which has a first flexible strap 202 attached to one side. The first flexible strap 202 has ribbing 203 on the underside and two snap jaws 206 on either side at the open end. On the opposite side of the base is located a second flexible strap 204 having ribs 205 on the upper surface which correspond to the ribs 203 on the under surface of the first strap. The mechanical release mechanism 107 may be attached to the spool flange 102 in FIG. 4 by means of a screw 207. The spool line 2 is then passed between the two straps 202 and 204 and the strap 204 folded downward and then the first strap 202 folded downward over the strap 204 until the snap jaws 206 engage the first strap by friction. The ribs 203 and 205 provide additional frictional connection between the two straps. The strap as shown is made of light gage polyethelene plastic and manufactured by Panduit Company. Due to the construction, the frictional force of the jaws 206 and the ribs 203 and 205 may easily be overcome by the buoyant force of the spool.

It should be understood that there are many other embodiments that are not shown which fall within the intent and spirit of the invention as described in the attached claims. For example, the spool line may be connected to directly to the object to be relocated, or the lug chain and anchor pennant line may be deleted.

What is claimed is:

1. An apparatus for relocating an underwater object comprising in combination:
   (a) a buoyant spool having flanges on either end, said spool defining a lengthwise hole along the central axis thereof;
   (b) an acoustic transponder disposed within said hole, said transponder including an end cap assembly having a releasable catch, said releasable catch opening in response to an acoustic signal received by said transponder;
   (c) A spool line attached to said spool by a first end and wound about said spool between said flanges;
   (d) attachment means for attaching the second end of said spool line and said releasable catch to said object.

2. The apparatus of claim 1 further comprising a mechanical release means for releasably securing said spool line to said spool between said second end and the last winding of said spool line about said spool; said release mechanism releasing said spool line in response to the buoyancy of said spool.

3. The apparatus of claim 1 wherein said transponder further includes a light on the end opposite said end cap assembly, said light flashing in response to the same acoustic signal that opens said releasable catch.

4. The apparatus of claim 1 wherein said attachment means comprises:
   (a) a first ring through said releasable catch;
   (b) a second ring on the second end of said spool line and connected to said first ring; and
   (c) a third ring connecting said first ring and the object to be relocated.

5. The apparatus of claim 4 wherein said attachment means further comprises a mooring line attached by a mooring line first into second, third ring and attached by a mooring line second into the object to be relocated, the length of said mooring being selected such that said spool is held below the surface of the water at depth sufficient to be clear of any surface traffic.

6. The apparatus of claim 5 wherein said attachment means further comprises a weighted chain end and anchor pennant line interposed between said mooring line and said object and arranged such that said anchor pennant line is connected by one end to said object and to one end of said chain by the other end, and the other end of said chain being connected to said mooring line second end.

* * * * *